United States Patent [19]

Kugler

[11] 4,300,346

[45] Nov. 17, 1981

[54] EXTENSIBLE STRAP

[75] Inventor: Hans Kugler, Bad Soden, Fed. Rep. of Germany

[73] Assignee: Hans E. Kalanke, Bachhausen, Fed. Rep. of Germany

[21] Appl. No.: 51,882

[22] Filed: Jun. 25, 1979

[30] Foreign Application Priority Data

Jun. 30, 1978 [DE] Fed. Rep. of Germany ..... 2828862

[51] Int. Cl.[3] ..... A44C 5/08

[52] U.S. Cl. ..... 59/79 R; 224/175

[58] Field of Search ..... 59/79 R; 224/175, 179; 63/5 R, 11

[56] References Cited

FOREIGN PATENT DOCUMENTS 1021612 12/1957 Fed. Rep. of Germany ..... 224/175

1021613 12/1957 Fed. Rep. of Germany ..... 224/175

1242927 6/1967 Fed. Rep. of Germany ..... 59/79 R 1557500 2/1971 Fed. Rep. of Germany .

353928 6/1961 Switzerland ..... 59/79 R

*Primary Examiner*—John McQuade

*Attorney, Agent, or Firm*—Edwin T. Grimes

[57] ABSTRACT

An extensible watch strap is made up from tubular links which extend transverse to the length of the strap. The links are arranged in two rows with the links in one row offset from the links in the other row. Each link is connected to the two adjacent links in the other row by U-shaped connectors which have limbs projecting into respective links. The limbs are received between pairs of leaf springs which act in the longitudinal direction of the strap and tend to push both of the limbs which are received in each link against each other.

4 Claims, 6 Drawing Figures

EXTENSIBLE STRAP

The invention relates to an extensible link strap, such as a watch strap, comprising two layers of tubular links which are offset relative to each other by approximately half the link width and are pivotably joined to each other on both longitudinal edges by means of approximately U-shaped connecting bars, a first member of every two of which is inserted into the open end of a link associated with the first layer and a second member is inserted into the open end of two adjacent links of the second layer and, when the strap is extended or flexed, act against the force of the leaf spring systems disposed in the tubular links.

Link straps of this kind are used to a large extent because they have a number of advantages. On the one hand they are practical in handling because it is not necessary to actuate any closure when they are attached or removed. On the other hand they are convenient to wear because they can be held in any desired position on the arm and do not constrict. Furthermore, their length can be readily changed because superfluous links can easily be removed or additional links can be added since to this end it is merely necessary to withdraw the connecting bars from the links in question or to connect additional links by means of the connecting bars. In addition to these advantages conventional link straps are also relatively inexpensive because their individual components can be produced and assembled substantially by automatic means.

The serious disadvantage of known link straps of the kind described hereinbefore is due to the relatively large structural height of the strap perpendicularly to the longitudinal extent thereof. This large structural height is due to the fact that each of the leaf spring systems disposed in the tubular links acts perpendicularly to the longitudinal extent of the strap. This is because the spring system comprises a leaf spring extending within the tubular link and having a longitudinal section in the shape of a shollow V and the connecting bars, adapted to cooperate with the appropriate leaf spring, thrust from above on the free ends of the members of the V-shaped leaf spring. Due to the arrangement thus described the structural height of the links is defined by the spring travel required by the leaf spring system within the tubular links. Since the link straps should have a relatively long extended length it follows that the structural height of the links is relatively large. Since the strap comprises two layers of links it follows that the vertical spring travel or the resultant structural height of the links occurs twice in the overall thickness of the strap.

The development in watches is towards shapes which are as thin as possible.

The invention provides an extensible link strap of the kind described hereinbefore wherein each leaf spring system in the tubular links is formed by two leaf springs which act opposite to each other in the longitudinal direction of the strap and between which the two members of the connecting bars engage.

The link strap according to the invention differs from known straps of conventional construction mainly by virtue of the leaf spring system within the tubular links acting along the longitudinal extent of the strap. Accordingly, the height of the links is defined only by the structural height of the leaf springs and not by the spring travel which they require. A small structural height is obtained for the links since the leaf springs can be kept rather narrow. It is therefore possible to construct thin straps.

The link strap according to the invention can be constructed to be more extensible because there is a relatively large degree of freedom as regards the choice of the width of the links and therefore of the spring travel of the leaf springs which act along the longitudinal extent of the strap.

The link wrist strap according to the invention can readily be produced with an overall thickness of 2.5 mm; it can therefore be advantageously employed in conjunction with extremely slim watches.

In one advantageous further embodiment of the strap construction according to the invention the two leaf springs have a corrugated shape or the like, complementary with each other over a portion of their length.

By virtue of this construction of the leaf springs they lock against each other in positive manner if the connecting bars are withdrawn from the relevant link so as to prevent the leaf springs dropping out of the said link. This facilitates the connection of additional links to or the removal of superfluous links from the link strap according to the invention.

In another advantageous embodiment of the link strap according to the invention the members of the connecting bar are disposed offset relative to each other, perpendicularly to the longitudinal extent of the strap. To this end the connecting bars are arranged so that in the unextended state of the link strap the members are situated approximately in the middle of the relevant link. This results in optimum utilization of the width of the links as regards the available spring travel of the two leaf spring disposed in a sleeve. Accordingly, the strap has a large extensibility.

It is also advantageous if the web, which interconnects the members of the connecting bar, is constructed in S- or Z-configuration. By virtue of the above-described shape of the webs associated with the connecting bars the side view of the link wrist strap according to the invention can be varied thus increasing the design facilities of the link strap according to the invention.

It is of course possible for the leaf springs as well as for the connecting clips to be constructed as desired within wide ranges.

The invention will now be further described, by way of example, with reference to the accompanying drawings in which.

Figure 4A:
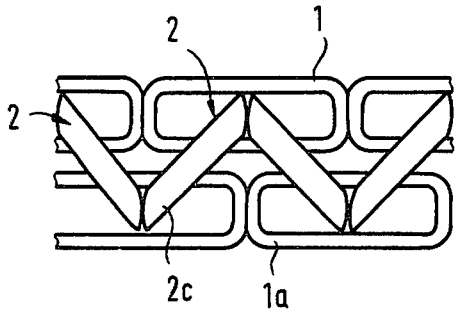
FIGS. 4*a* to 4*c* are side views of link straps with differently constructed connecting bars.
Figure 4B:
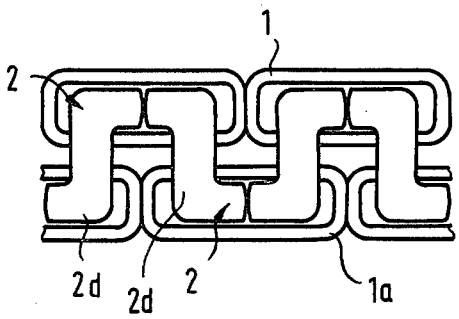
Figure 4C:
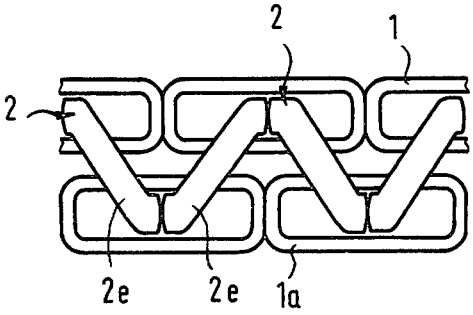

The basic construction of the link strap is disclosed in FIGS. 4*a* to 4*c*. According to these illustrations the link strap comprises two layers of tubular links 1 or 1*a* which are arranged so as to be offset relative to each other by approximately half the link width in the longitudinal orientation of the strip. At the two longitudinal strap edges the links 1 or 1*a* are pivotably joined to each other by approximately U-shaped connecting bars 2 of which the first member of every two such bars is inserted into the open end of the link, for example 1 of one layer, and the other member is inserted into the open end of two adjacent links, for example 1*a*, of the second layer.

Figure 1:
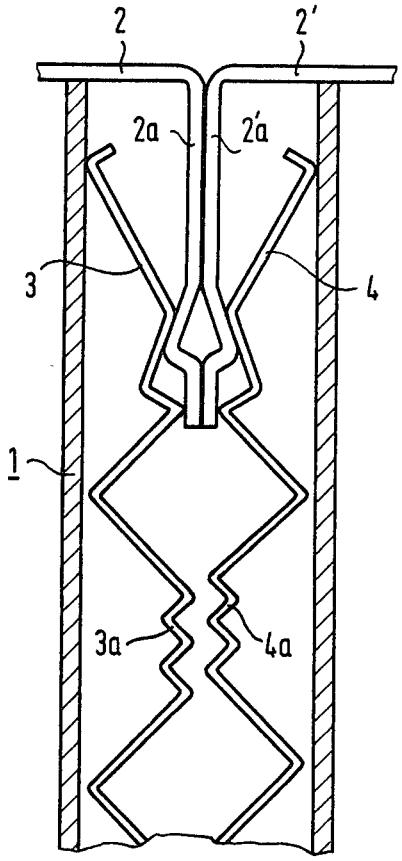
FIG. 1 is a section, extending in the longitudinal orientation of the strap, through a tubular element of a link strap according to the invention in the unextended state.
Figure 2:
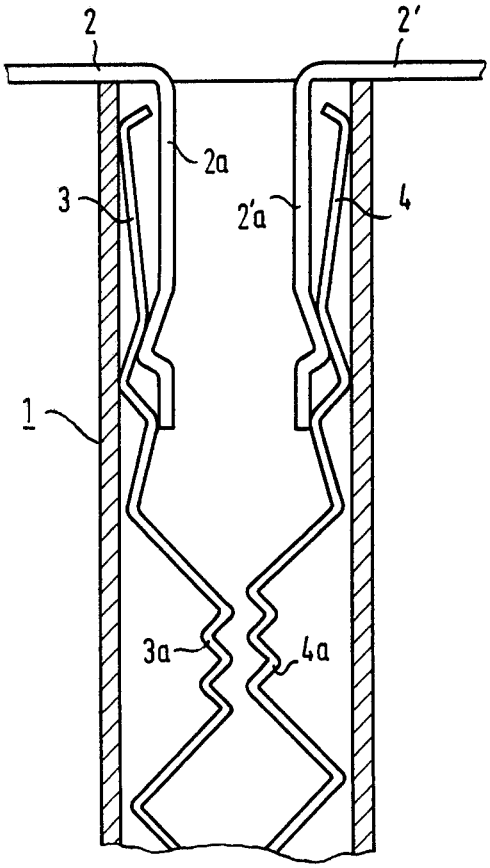
FIG. 2 shows the arrangement according to FIG. 1 with the strap extended.
Figure 3:
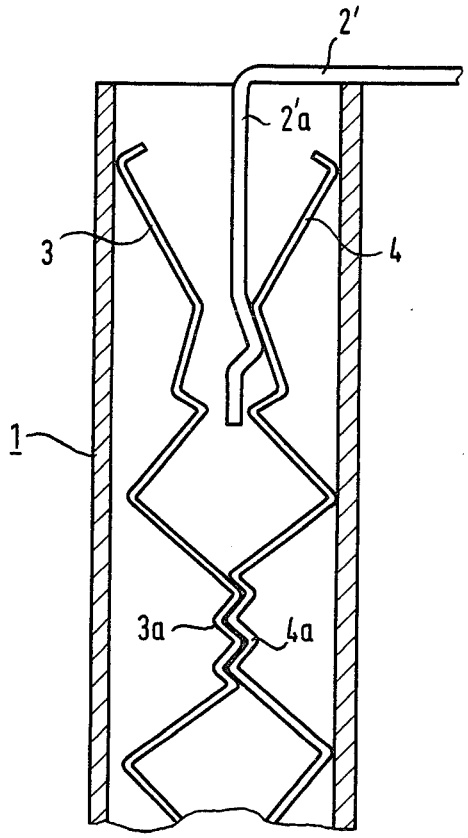
FIG. 3 shows the arrangement according to FIG. 1 from which one connecting bar is removed.

As can be seen by reference to FIGS. 1 to 3, which represent a section through a tubular link 1 in the longitudinal orientation of the strap, two leaf springs 3 and 4 are disposed within the relevant tubular link 1. The said leaf springs extend in the longitudinal orientation of the tubular link and are so formed and inserted with prestress into the tubular link 1 so as to act against each other while tending to bear upon each other. The appropriate members 2*a* and 2'*a* of the connecting bars 2 and 2' are inserted between the leaf springs 3 and 4 which act in the manner described. In the unextended position of the link strap shown in FIG. 1, the prestressing force of the springs 3 and 4 acting on the connecting bars 2 and 2' is so dimensioned that the adjacent links of a first layer as well as the associated links of the second layer are firmly pulled against each other with the necessary tension. When the strap is extended or flexed the leaf springs 3 and 4 are spread via the connecting bars 2 and 2' against their spring force which acts in the longitudinal orientation of the strap, as indicated in FIG. 2, and the members 2*a* or 2'*a* of the connecting bars 2 or 2' in the tubular link 1 are moved apart along the width extent of the said link. If the tensile stress acting on the link strap or on the corresponding link strap portion is again removed, the leaf springs 3 and 4 will again compress the members 2*a* and 2'*a* of the connecting bars so that the adjacent links are again drawn by means of the connecting bars 2 and 2' against the link under consideration.

The leaf springs have a corrugated shape 3*a* or 4*a*, complementary with each other, at least along one portion of each spring, which portions are adjacent to each other in the installed state. As can be seen by reference to FIG. 3 the complementary corrugated shapes 3*a* and 4*a* of the leaf springs 3 and 4 bear positively upon each other if either a connecting bar, for example 2, or both connecting bars is or are withdrawn. This causes the leaf springs 3 and 4 to stress themselves captively within the tubular link 1. This feature substantially facilitates fitting of the link strap or the removal of superfluous links or the connection of additional links.

As can be seen by reference to FIGS. 4*a* to 4*c* the members of each connecting bar 2 are offset relative to each other in a plane which is perpendicular to the longitudinal extent of the strap. The relevant connecting bar is inserted into the two links which are to be connected by the bar so that in the unextended position of the link strap the relevant member is positioned approximately in the middle of the width extent of the appropriate length to provide a maximum amount of travel for the appropriate member within the associated link so as to result in a very extensible strap.

According to FIG. 1 the web 2*c* which interconnects the members of the appropriate connecting element 2 is constructed in rectilinear form, the web 2*d* of connecting element 2 in FIG. 4*b* is of Z-configuration, and the web 2*e* of the connecting element 2 is of S-configuration. Freedom of choice of shape for the web of the connecting links permits variation in the side view of the link strap, as shown in the illustration of FIGS. 4*a* to 4*c*.

What I claim is:

1. An extensible strap comprising a plurality of tubular links arranged in two rows with the length of each link transverse to the length of the strap and the links in one row offset by half a link width from the links in the other row, each link containing two leaf springs arranged to act in the longitudinal direction of the strap and being connected to the two adjacent links in the other row by connecting members, which have arms projecting into respective links to be received between the leaf springs, two connecting member arms being received between each pair of leaf springs, and means for locking said leaf springs in their respective links to prevent them form slipping out of the link, said means for locking said leaf springs being characterized by the two leaf springs having complementary corrugated shapes over portions of their lengths.

2. An extensible strap according to claim 1, wherein the arms of the connecting members are offset relative to each other perpendicular to the longitudinal direction of the strap.

3. An extensible strap according to claim 1, wherein said connecting members have a web interconnecting the arms thereof, said web having an S-shaped configuration.

4. An extensible strap according to claim 1, wherein said connecting members have a web interconnecting the arms thereof, said web having a Z-shaped configuration.

* * * * *